US010519719B2

(12) United States Patent
Bullock et al.

(10) Patent No.: US 10,519,719 B2
(45) Date of Patent: Dec. 31, 2019

(54) RETRACTABLE AUGER HEAD

(71) Applicant: Radius HDD Direct LLC, Perry, OK (US)

(72) Inventors: David Bullock, Weatherford, TX (US); Ronald F. Wright, Weatherford, TX (US); Toby Wright, Fort Worth, TX (US); Thomas Miller, Weatherford, TX (US); Boston Bullock, Weatherford, TX (US)

(73) Assignee: Radius HDD Direct LLC, Perry, OK (US)

( * ) Notice: Subject to any disclaimer, the term of this patent is extended or adjusted under 35 U.S.C. 154(b) by 224 days.

(21) Appl. No.: 15/603,715

(22) Filed: May 24, 2017

(65) Prior Publication Data

US 2017/0342776 A1 Nov. 30, 2017

Related U.S. Application Data

(60) Provisional application No. 62/340,867, filed on May 24, 2016.

(51) Int. Cl.

| | |
|---|---|
| ***E21B 10/20*** | (2006.01) |
| ***E21B 7/20*** | (2006.01) |
| ***E21D 9/10*** | (2006.01) |
| ***E21B 12/00*** | (2006.01) |

(52) U.S. Cl.

CPC ..... *E21B 10/20* (2013.01); *E21B 7/20* (2013.01); *E21D 9/104* (2013.01); *E21B 12/00* (2013.01); *E21D 9/1093* (2013.01)

(58) Field of Classification Search

CPC . E21B 10/20; E21B 7/20; E21B 12/00; E21D 9/104; E21D 9/1093

See application file for complete search history.

(56) References Cited

U.S. PATENT DOCUMENTS 1,401,545 A * 12/1921 McCormick ..... E21B 10/325 175/277
7,367,412 B2 5/2008 Barbera et al.
2007/0251730 A1* 11/2007 Barbera ..... E21B 7/201 175/274

* cited by examiner

*Primary Examiner* — David J Bagnell
*Assistant Examiner* — Dany E Akakpo
(74) *Attorney, Agent, or Firm* — Tomlinson McKinstry, P.C.

(57) ABSTRACT

A retractable auger boring cutter head. The cutter head has fixed cutters and at least one pivoting cutter. The pivoting cutter is biased to a position that extends beyond a diameter of a casing being installed. When pulled back through the casing, a surface of the pivoting cutter contacts the casing, reducing the effective diameter of the cutter head and allowing it to be removed.

19 Claims, 13 Drawing Sheets

RETRACTABLE AUGER HEAD

CROSS-REFERENCE TO RELATED APPLICATION

This application claims the benefit of U.S. Provisional Patent Application Ser. No. 62/340,867 filed on May 24, 2016, the entire contents of which are incorporated herein by reference.

SUMMARY

This invention relates generally to a cutting assembly comprising a base plate, a plurality of first bits, a second bit, and a biaser. The plurality of first bits are fixed in position relative to the base plate. The second bit is pivotally attached to the base plate and movable between a first and second position. The biaser forces the second bit away from the plurality of first bits and increases an effective diameter of the cutting assembly.

This invention also is directed to a method for installing a pipe casing. The method comprises providing a cutting assembly having a center of rotation and a plurality of cutters. At least one of the plurality of cutters is pivotable from a first position to a second position. The cutting assembly is placed on a rotatable shaft. A pipe casing is disposed about the rotatable shaft. The shaft and cutting assembly are rotated at the drilling location when the at least one of the plurality of cutters is in the first position. The shaft and cutting assembly are retracted through the pipe casing when the at least one of the plurality of cutters is in the second position. The at least one of the plurality of cutters is further from the center of rotation than the pipe casing when in the first position. The cutting assembly is circumscribed by the pipe casing when in the second position.

DETAILED DESCRIPTION

Figure 1:
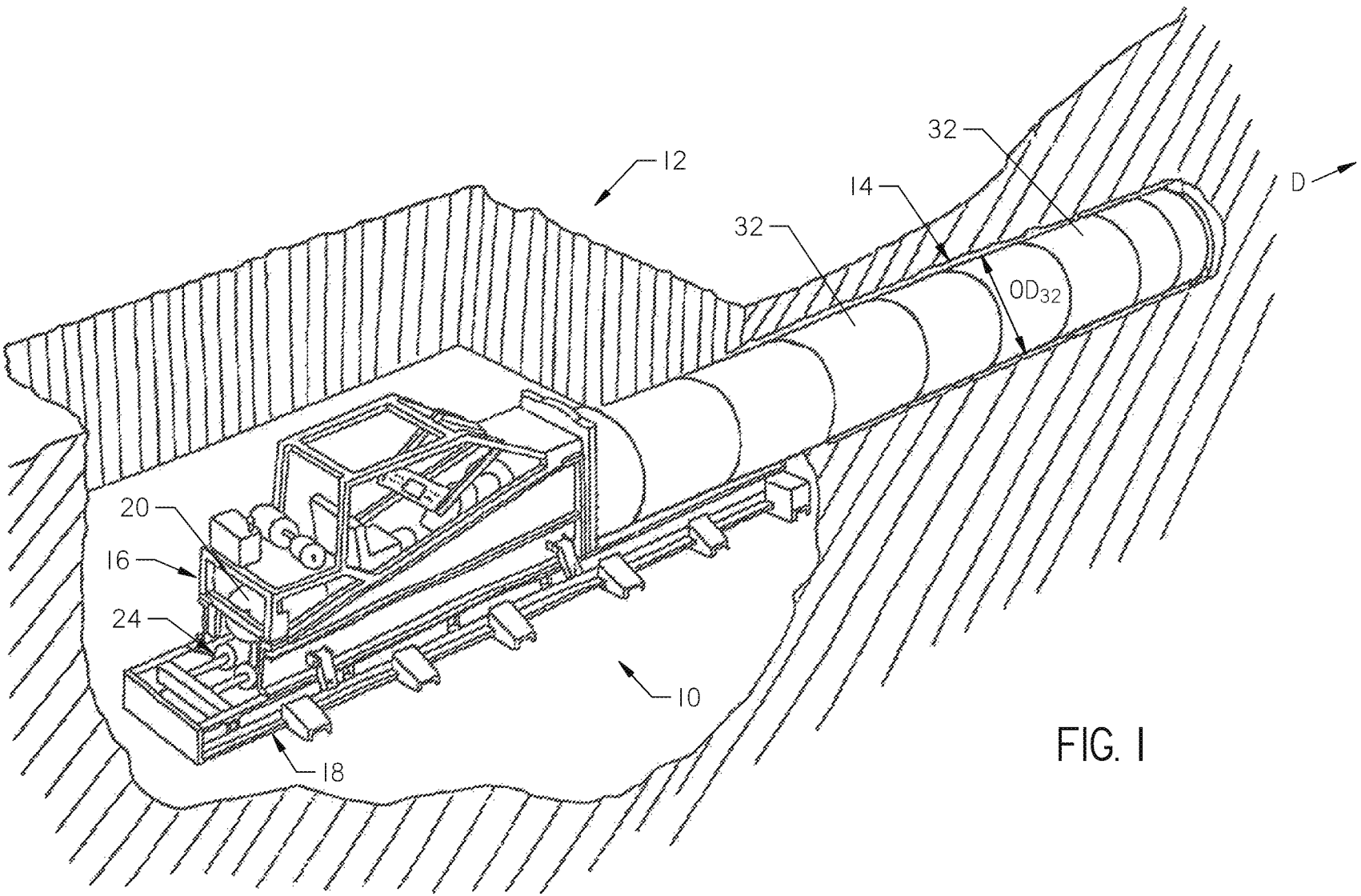
FIG. 1 is a diagrammatic representation of an auger boring machine.

Referring now to FIG. 1, a boring machine 10 is located in launch pit 12 and is shown as it would appear in the process of boring a tunnel 14. Boring machine 10 comprises a carriage 16 which is mounted on and adapted to move along a track 18 in boring direction D. The carriage includes a motor 20 for operating a selected cutting assembly, such as a cutter head 22 (FIG. 2), and a pusher mechanism 24 for pushing or driving the carriage along, the track 18 in direction D.

Figure 2:
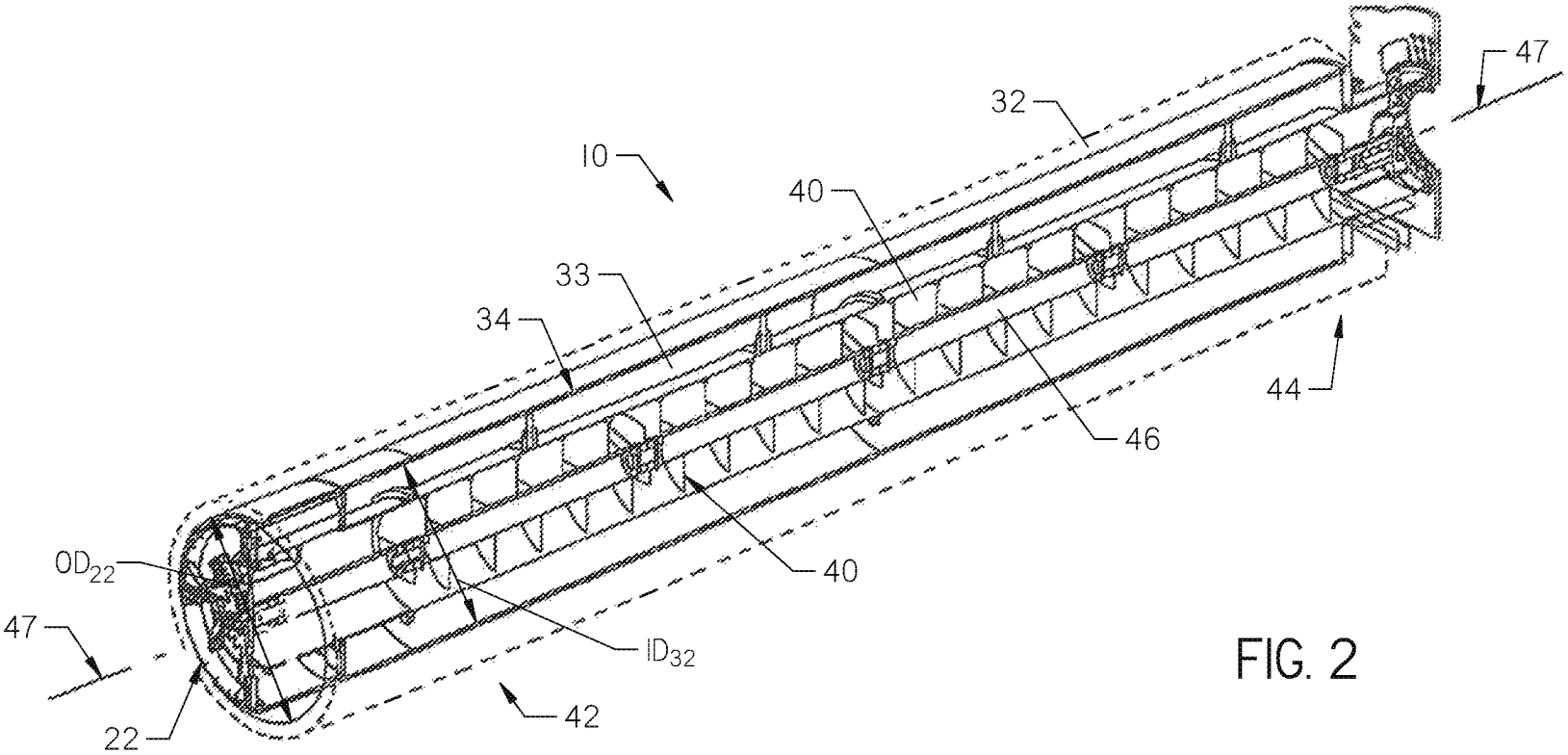
FIG. 2 is a partial cutaway view of an auger boring machine with the casing cut-away and the auger and cutter head shown.
Figure 3:
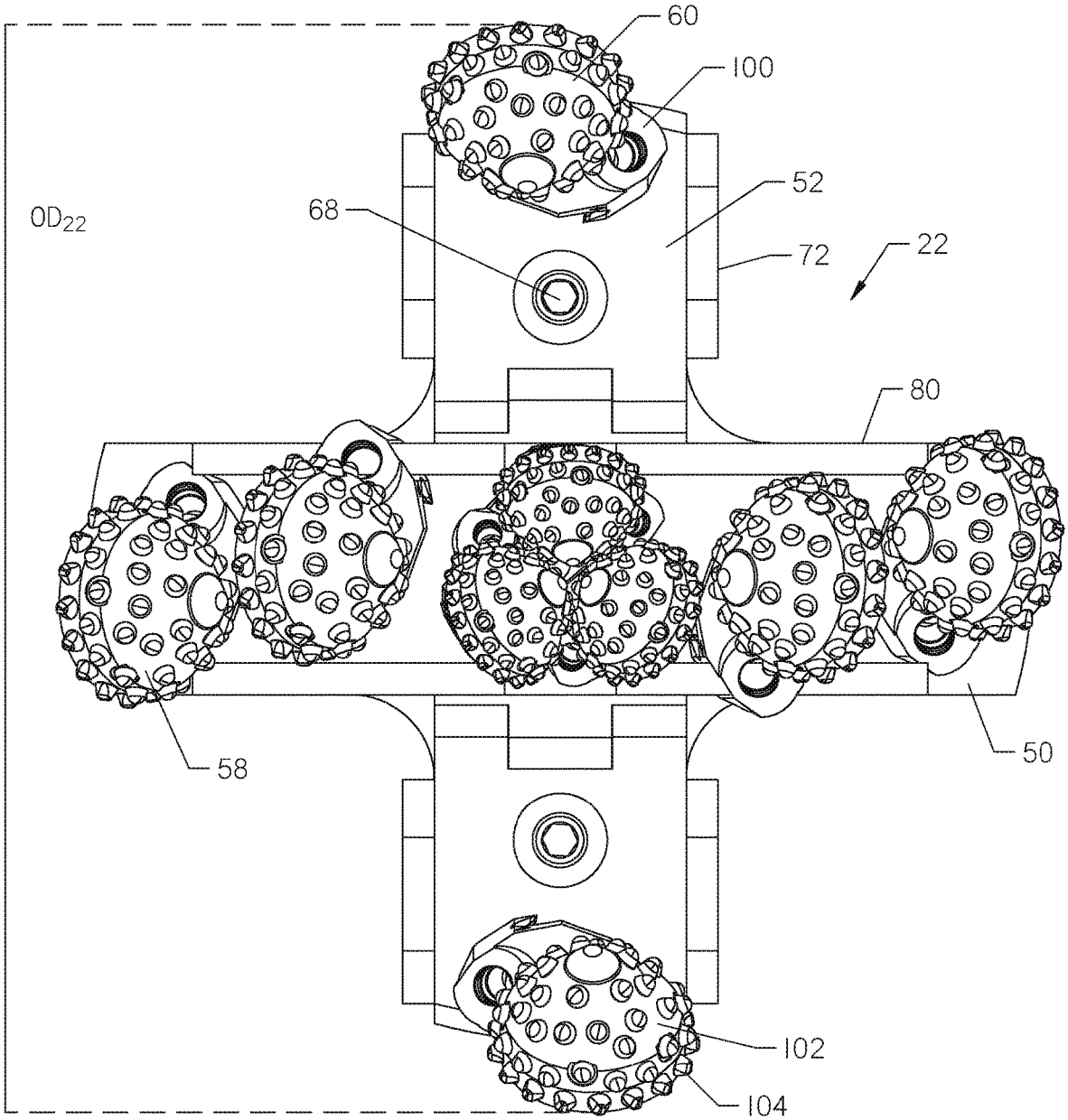
FIG. 3 is a front view of a cutter head for use with the auger boring machine of FIG. 1. A pair of hinged cutters are shown in a first position.
Figure 4:
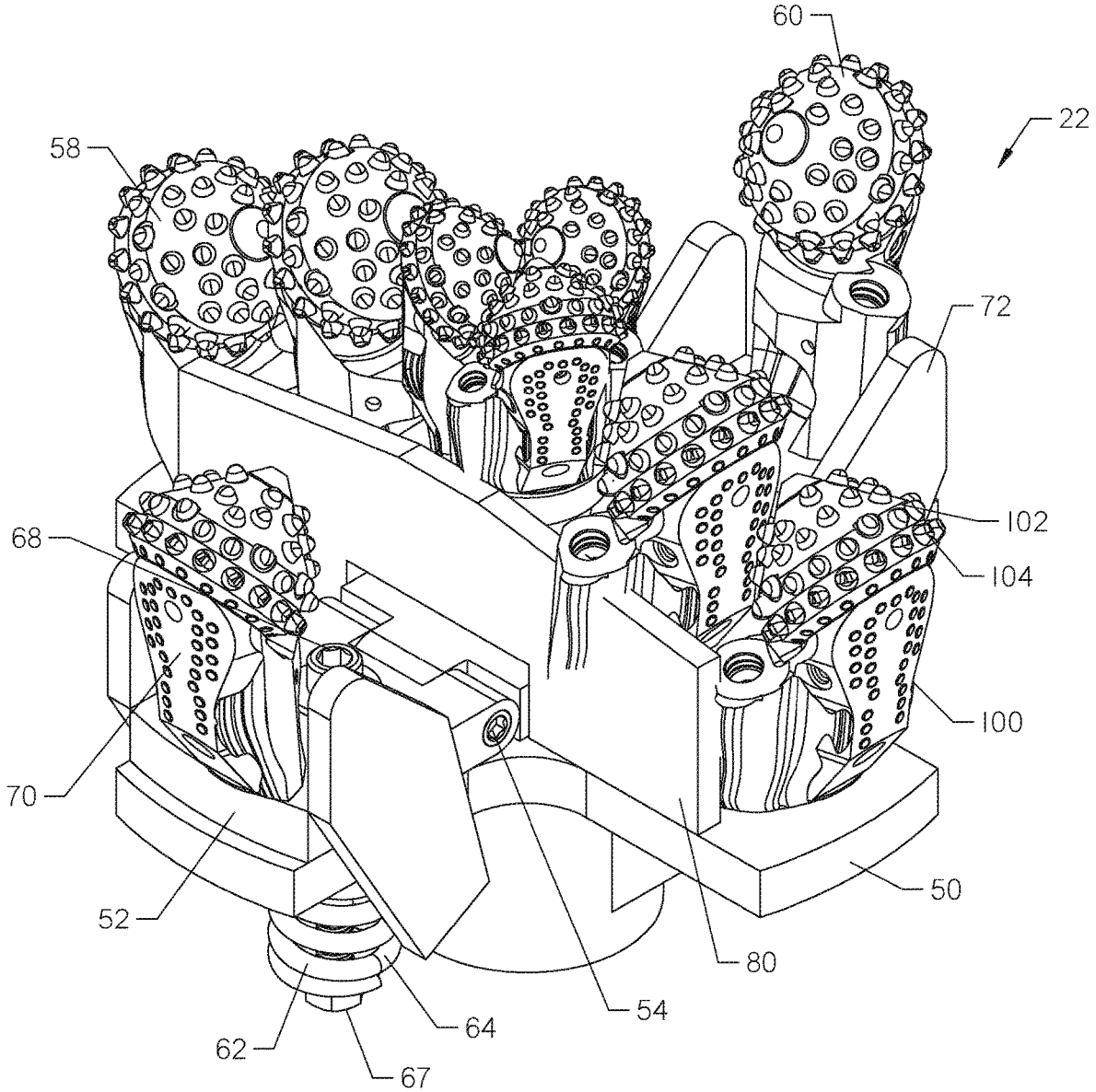
FIG. 4 is a front perspective view of the cutter head of FIG. 3.

As shown in FIGS. 1 and 2, the boring machine 10 comprises a tubular casing 32 having an internal diameter $ID_{32}$ and an outer diameter $OD_{32}$. The casing 32 typically comprises a product pipe to be installed. Thus, the preferred boring machine includes a plurality of sets of cutter heads 22 that vary in size for use with a plurality of differently-sized casings 32. An outside diameter $OD_{22}$ of the cutter head 22 should correspond or be larger than to the outside diameter $OD_{32}$ of the selected casing 32 to be installed.

The boring machine 10 also comprises a material conveyor such as an auger 40 that is located within the casing 32. Auger 40 has a front end 42 and a rear end 44 and is disposed about a shaft 46 having a longitudinal axis 47. The motor 20 (FIG. 1) is operationally connected to the auger 40. The shaft 46, and therefore the auger 40, rotates about the axis 47 with respect to casing 32.

The cutter head 22 is attached to the shaft 46 proximate the front end 42 of the auger 40. The cutter head 22 is rotated by the shaft 46 to dislodge spoils and create the tunnel 14. Dislodged spoils then are conveyed away from the cutter head 22 through the casing 32 by the auger 40. Orientation of the auger 40 about the shaft 46 determines the direction of rotation. For example, if the auger 40 advances to its front end 42 clockwise about the shaft 46, the shaft 46 should be rotated clockwise to drive spoils away from the cutter head 22.

Simultaneously with rotation of the auger 40, the pusher mechanism 24 (FIG. 1) drives the carriage 16 along the track 18, advancing the cutter head 22, auger 40, and casing 32 along boring direction D. For purposes of this invention, the shaft 46 and casing 32 may be advanced or retracted independently of one another.

The shaft 46 and casing 32 may be made of multiple sections. Casing 32 sections may be fused or threaded together. Shaft sections may be threaded or otherwise locked together in torque-transmitting relationship. Sections of auger 40 may be formed about each shaft 46 section.

In prior art auger boring machines, the requirement that the cutter head outer diameter be larger than the outer diameter of the casing prevents the cutter head and attached shaft 46 from being retracted. Therefore, when cutter head 22 breaks or wears out in drilling conditions downhole, the only way to replace or repair it is by digging an open trench or hole from the surface to the cutter head's location.

It is therefore advantageous to provide a cutter head 22, such as the present invention, that can be pulled to an entry point of the tunnel 14 for repair and replacement.

With reference to FIGS. 3-6, the cutter head 22 is shown in a first position. The cutter head 22 comprises a base plate 50 and at least one hinged plate 52. The hinged plate 52 is pivotable relative to the base plate 50 about a pivot 54. The base plate 50 supports one or more static cutting elements, or base cutters 58 and the hinged plate 52 supports one or more mobile cutting elements, or hinged cutters 60. The hinged plate 52 opens toward the axis 47. As shown, there are two hinged plates 52, each supporting one cutter 60. Two or more hinged cutters 60 may be placed at uniform angular spacing about the cutter head 22.

As shown, the cutters 58, 60 comprise roller cone bits, though teeth, plates, static conical bits, and other bits may be utilized in any advantageous combination. The cutter head 22 may comprise more than two hinged plates 52 and hinged cutters 60, if desired.

Roller cone bits, such as cutters 58, 60 shown in the Figures, are typically comprised of an arm 100 extending from a mounting location on either the base plate 50 or hinge plate 52. A cone 102 that rotates relative to the arm 100 is mounted on an end of the arm 100 and is typically covered in hardened teeth 104. The rotation of these cutters 58, 60 about the shaft axis 47, coupled with relative rotation of each cone 102 relative to the arms 100, encourages the dislodging of spoils and opening of the tunnel 14.

When the hinged cutters 60 are in the first position, as shown in FIGS. 3-6, the hinged plates 52 lay flat on and are parallel to the base plate 50. The hinged plates 52 are held on the base plate 50 via a biaser 62. The hinged plates 52 lay flat on the base plate 50 when the biaser 62 is fully relaxed. Thus, the hinged plates 52 and cutters 60 are in the first position when the biaser 62 is fully relaxed.

As shown, the biaser 62 comprises a spring 64. The spring 64 is disposed about a bolt 66 having a first end 67 and a second end 68. The bolt 66 is disposed through the hinged plate 52 and the base plate 50, and secured to the hinged plate 52 at the second end 68. The spring 64 is disposed between the base plate 50 and the first end 67 of the bolt 66. While the spring 64 shown is a metallic coiled spring, other embodiments of the biaser 62 may be contemplated. For example, an elastomeric spring or leaf spring could be utilized.

The hinged cutters 60 are shown in a second position in FIGS. 7-10. In this position, an external force acts directly against the hinged plate 52 or the hinged cutter 60. As shown, the hinged cutter 60 comprises a wall contact surface 70. The contact surface 70 is configured to contact an internal wall 33 of the casing 32 (FIG. 2) when the cutter head 22 and shaft 46 are pulled back through the casing. The force of the internal wall 33 against the wall contact surface 70 is sufficient to overcome the force of the biaser 62 and force the hinged cutters 60 into the second position.

It may be advantageous for the contact surface 70 to be convex, or to at least partially conform to the internal wall 33, though this is not necessary. The contact surface 70 may define one or more wear buttons to reduce friction between the internal wall 33 and the internal surface 70 when the cutting head 22 is pulled through the casing 32.

In the second position, the spring 64 is compressed between the first end 67 of the bolt 66 and the base plate 50. This compression is caused by a length of the bolt 66 being pulled through the base plate 50 by the pivoting movement of the hinged plate 52 relative to the base plate 50. When the hinged cutters 60 are in the second position, the cutter head 22 has an outside diameter $OD_{22}'$ that is less than the inner diameter $ID_{32}$ of the casing. The decrease in the outside diameter $OD_{22}'$ of the cutter head 22 allows the cutter head 22, auger 40 and shaft 46 to be removed through the casing 32.

When the hinged cutters 60 of the cutter head 22 are in the first position, it is preferred that $OD_{22}$ of the cutter head 22 be greater than $OD_{32}$, of the casing 32 by two to four inches. This allows clearance between the tunnel 14 (FIG. 2) and the casing 32 wall for easier installation of sections of the casing. When the cutter head 22 is in the second position, $OD_{22}$ may be essentially equal to $ID_{32}$, as the contact surface 70 will contact the internal wall 33 during removal.

As shown in FIGS. 3-10, a pair of guide plates 72 may also be attached to the hinged plates 52. The guide plates 72 are planar and attached to opposite sides of the hinged plates 52. The guide plates 72 may move between the first and second position with the hinged plates 52 and hinged cutters 60. The guide plates 72 help distribute torque while drilling throughout the cutter head 22. This helps to decrease the amount of shear stress put on the hinged plates 52 and cutters 60 due to rotational torque while drilling. The guide plates 72 also help keep the hinged plates 52 aligned with the base plate 50 while drilling and help to prevent debris from impacting the biases 62.

Figure 5:
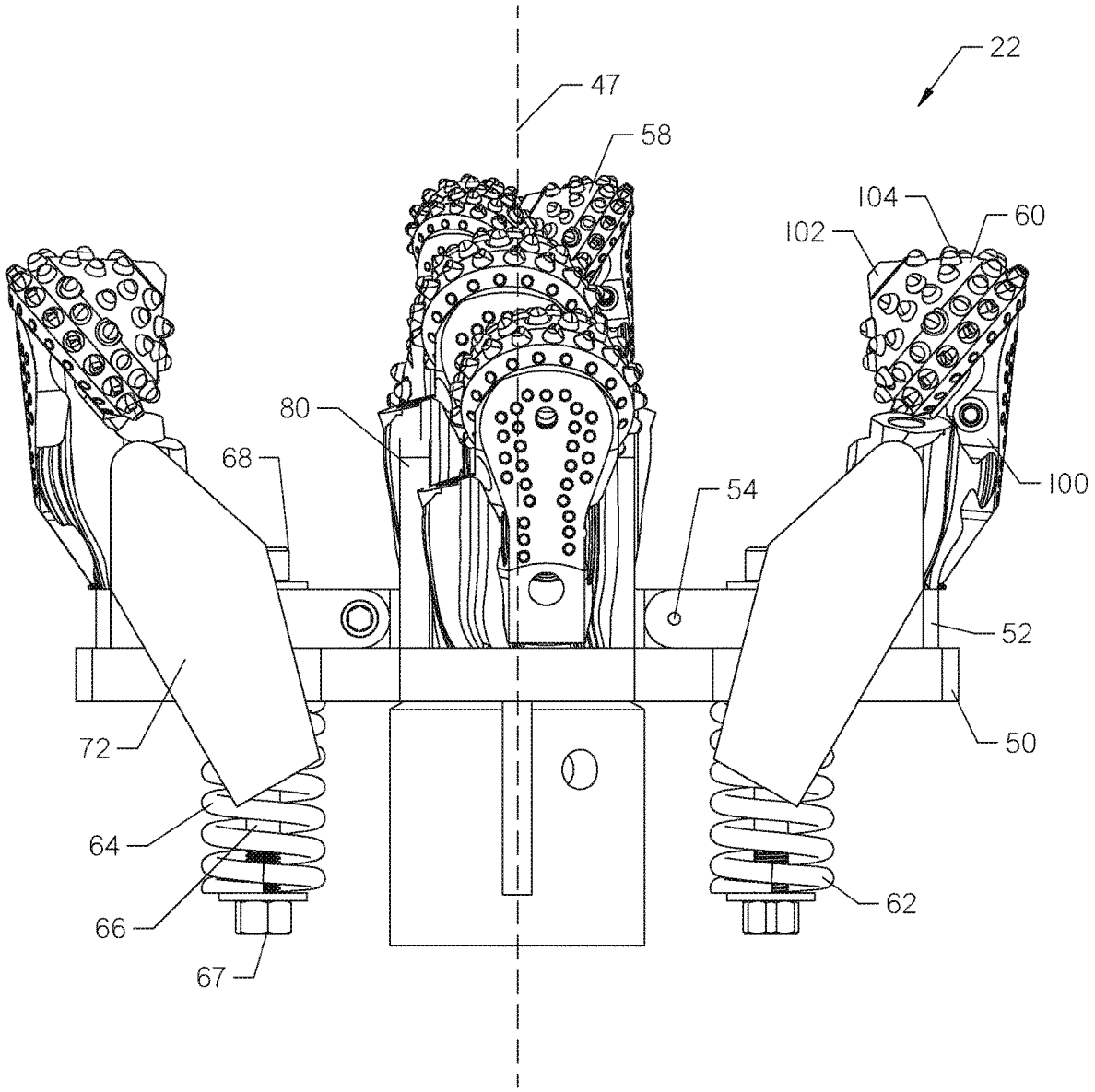
FIG. 5 is a side view of the cutter head of FIG. 3.
Figure 6:
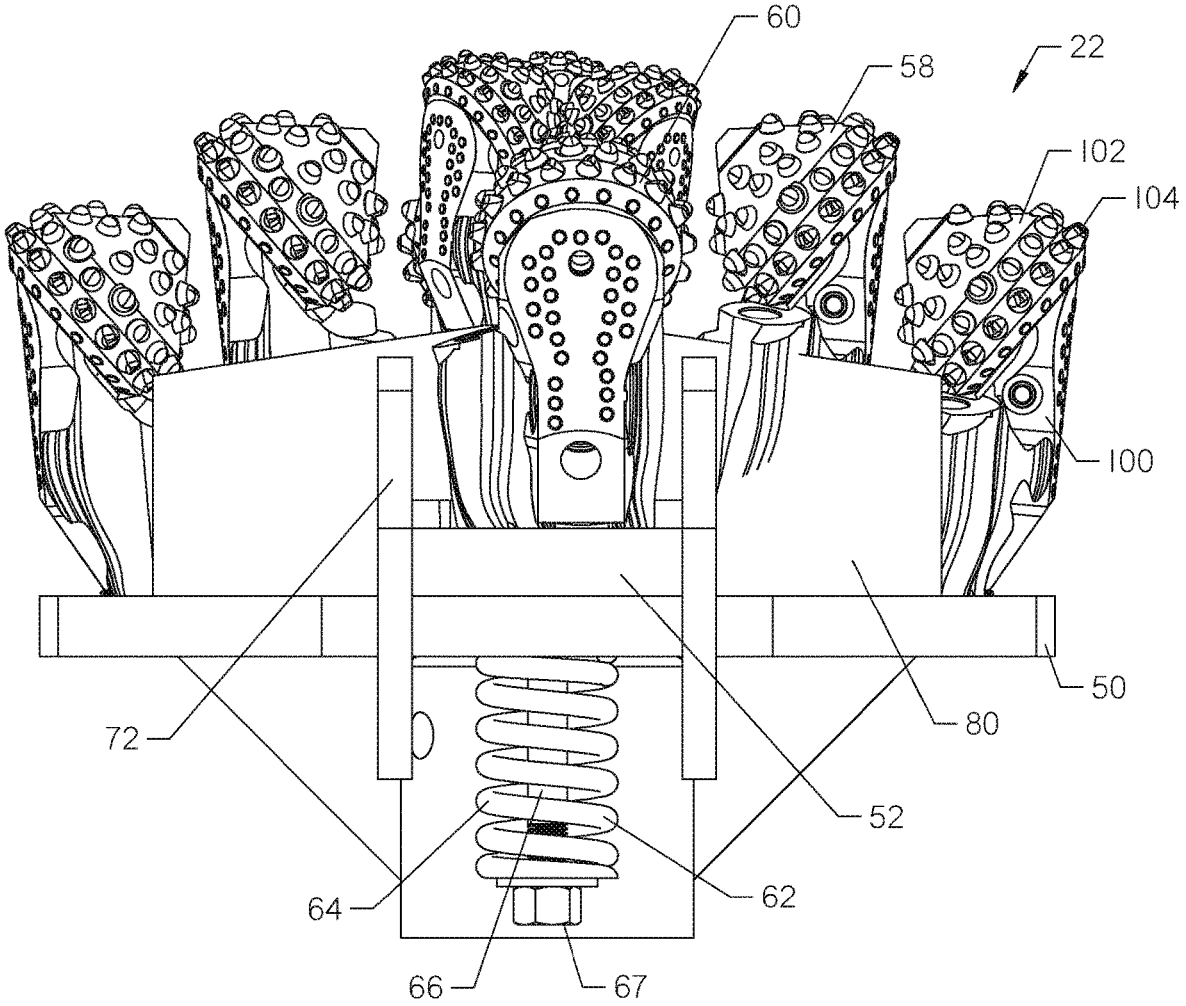
FIG. 6 is a top view of the cutter head of FIG. 3.
Figure 7:
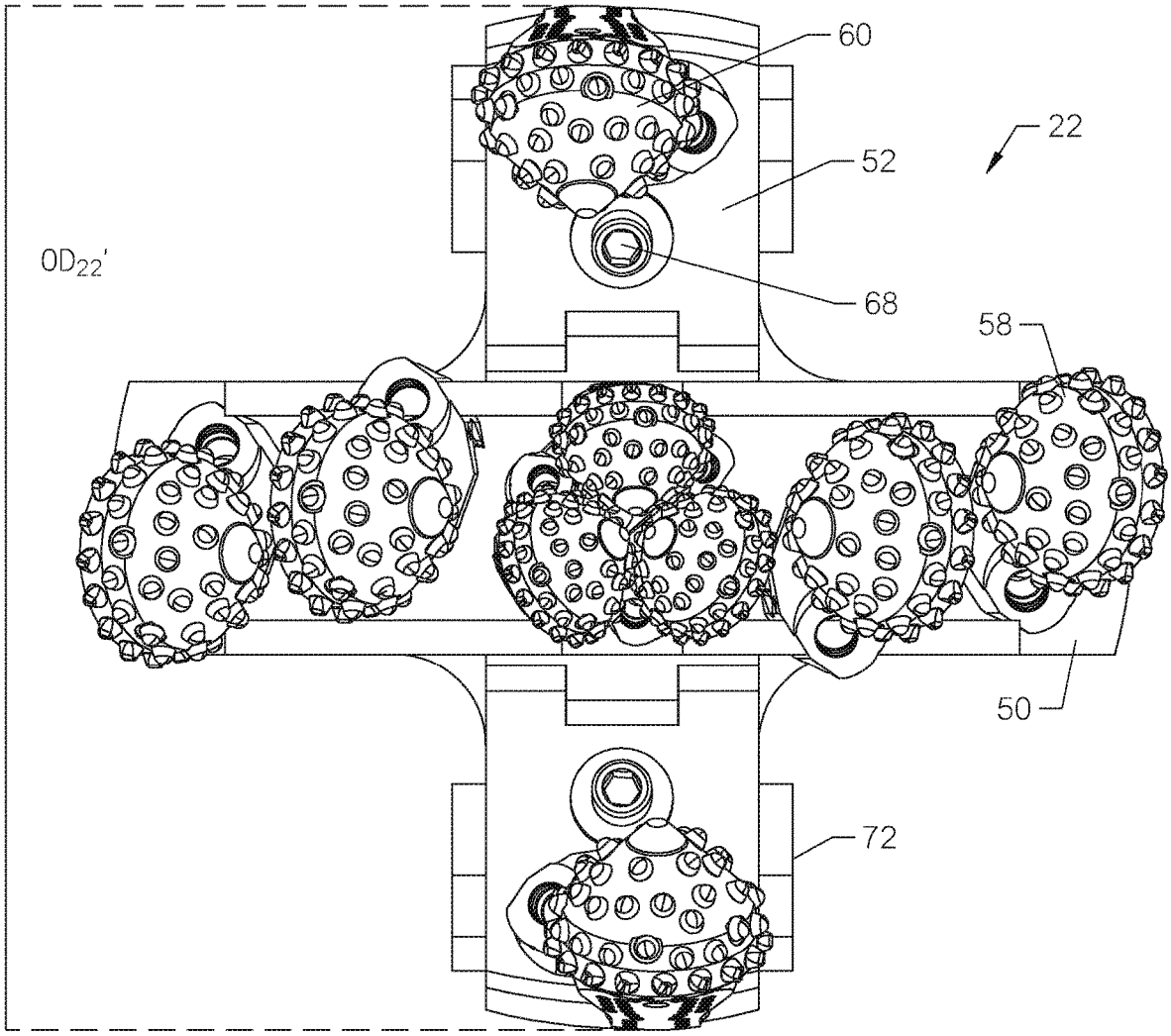
FIG. 7 is a front view of the cutter head with the hinged cutters shown in a second position.
Figure 8:
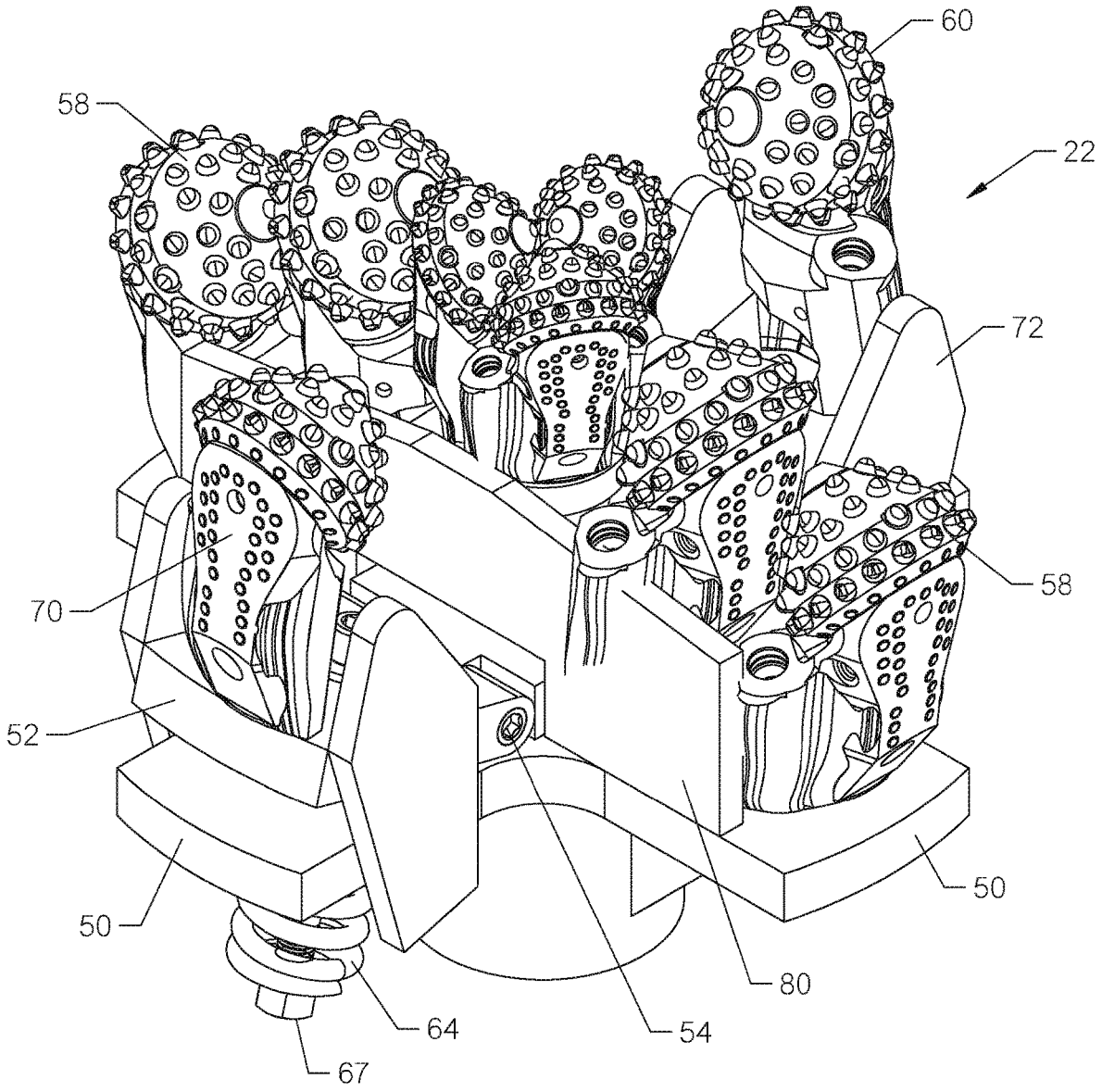
FIG. 8 is a front perspective view of the cutter head of FIG. 7.
Figure 9:
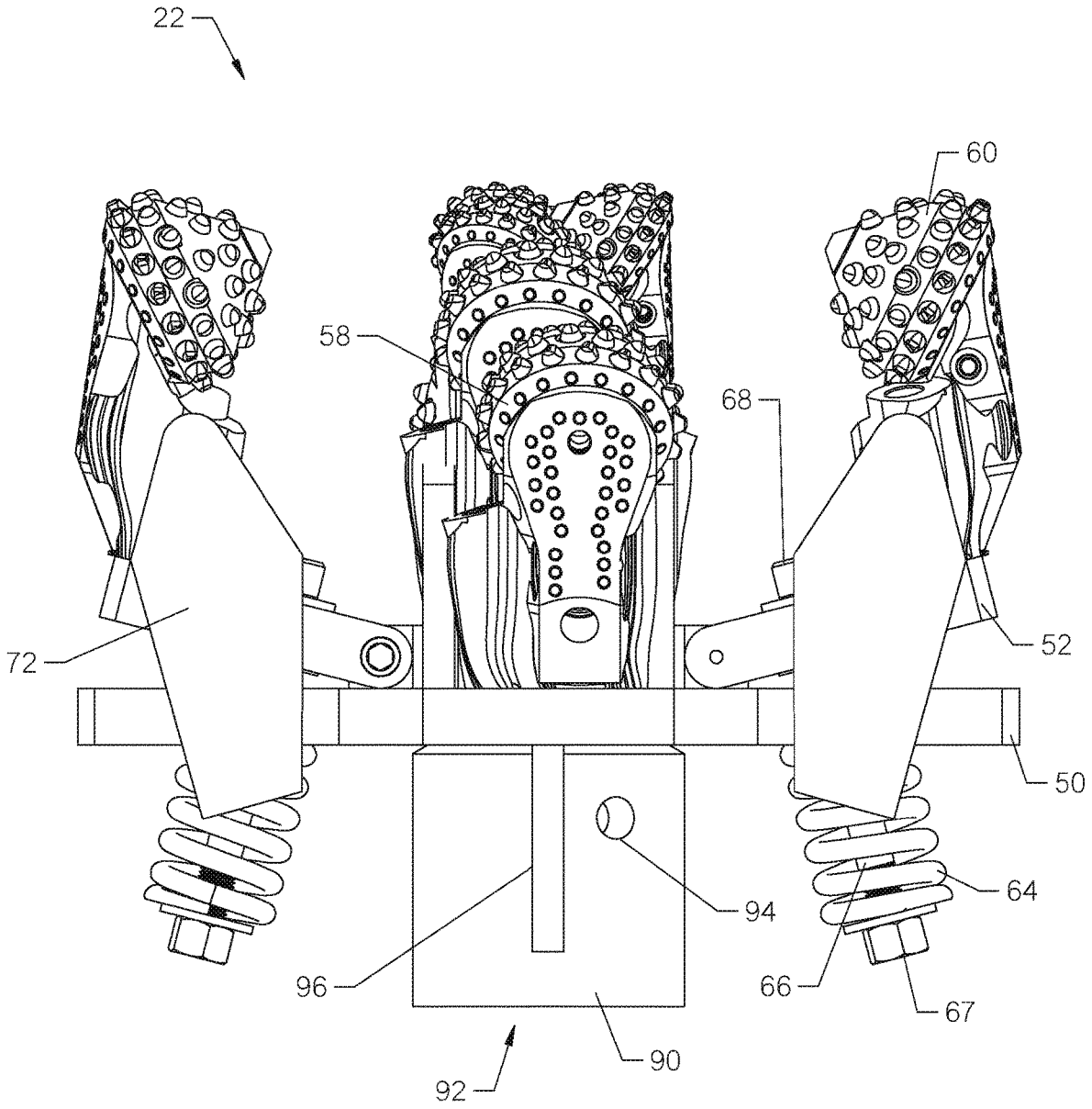
FIG. 9 is a side view of the cutter head of FIG. 7.

The base plate 50, as shown in FIGS. 3-10, supports seven base cutters 58. The base cutters 58 are disposed on the base plate 50 between two supports 80. The supports 80 may provide protection for non-cutting portions of the cutters 58 and increase the overall strength of the cutting head 22. The cutters 58 are disposed along a line perpendicular to a line between the two hinged cutters 60, though this design may be modified without departing from the spirit of this invention. The central-most base cutters 58 are disposed substantially around the axis 47 of rotation of the cutter head 22, as shown in FIGS. 5 and 9.

Each hinged plate 52 is attached to the base plate about the pivot 54. The pivot 54 may be a straight dowel or bolt formed in a slot in the base plate 50 and hinged plate 52 and disposed orthogonally to the axis 47. The pivot 54 may alternatively be a roll pin, hinge, ball joint, or other pivot.

Figure 10:
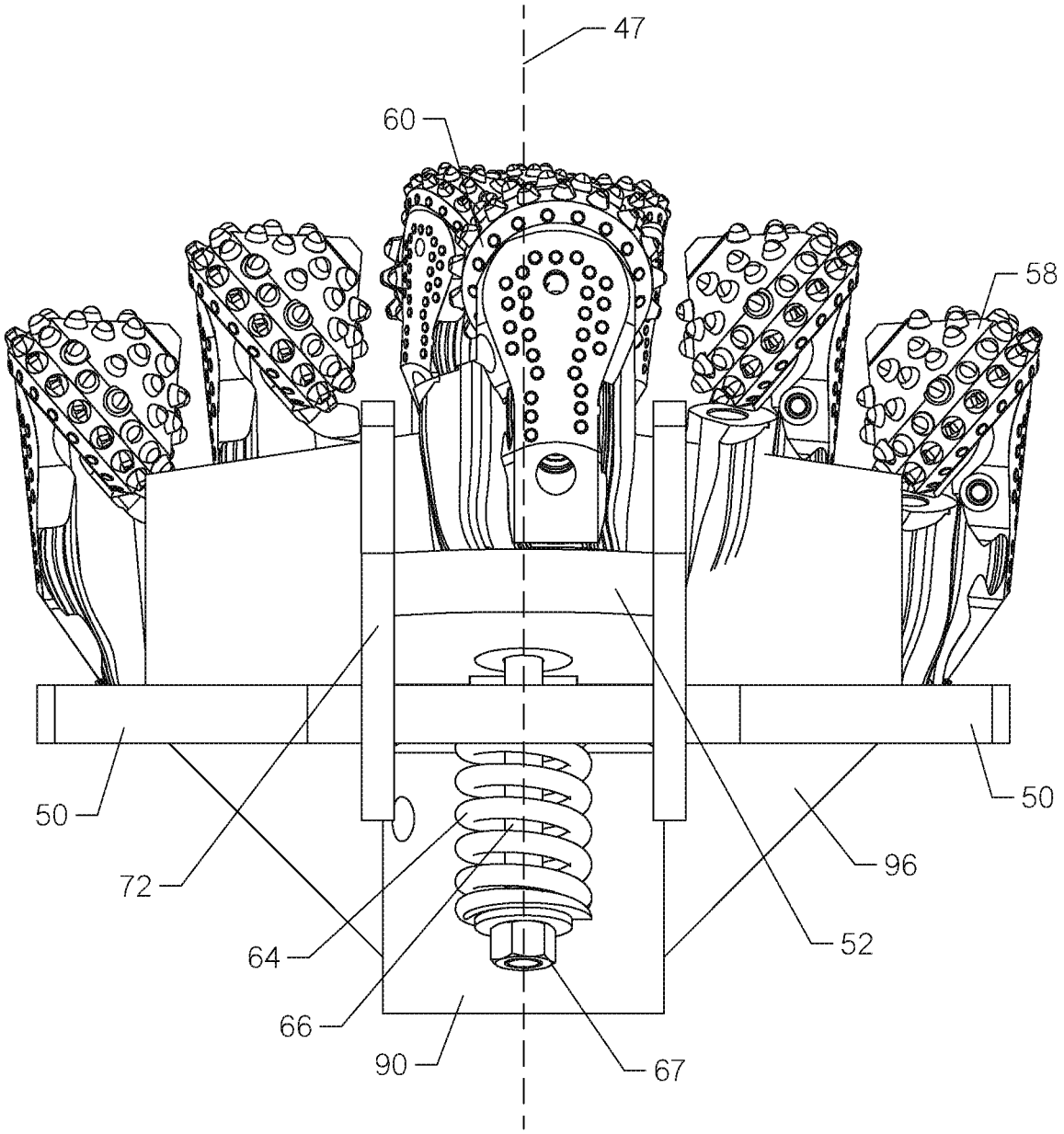
FIG. 10 is a top view of the cutter head of FIG. 7.
Figure 11:
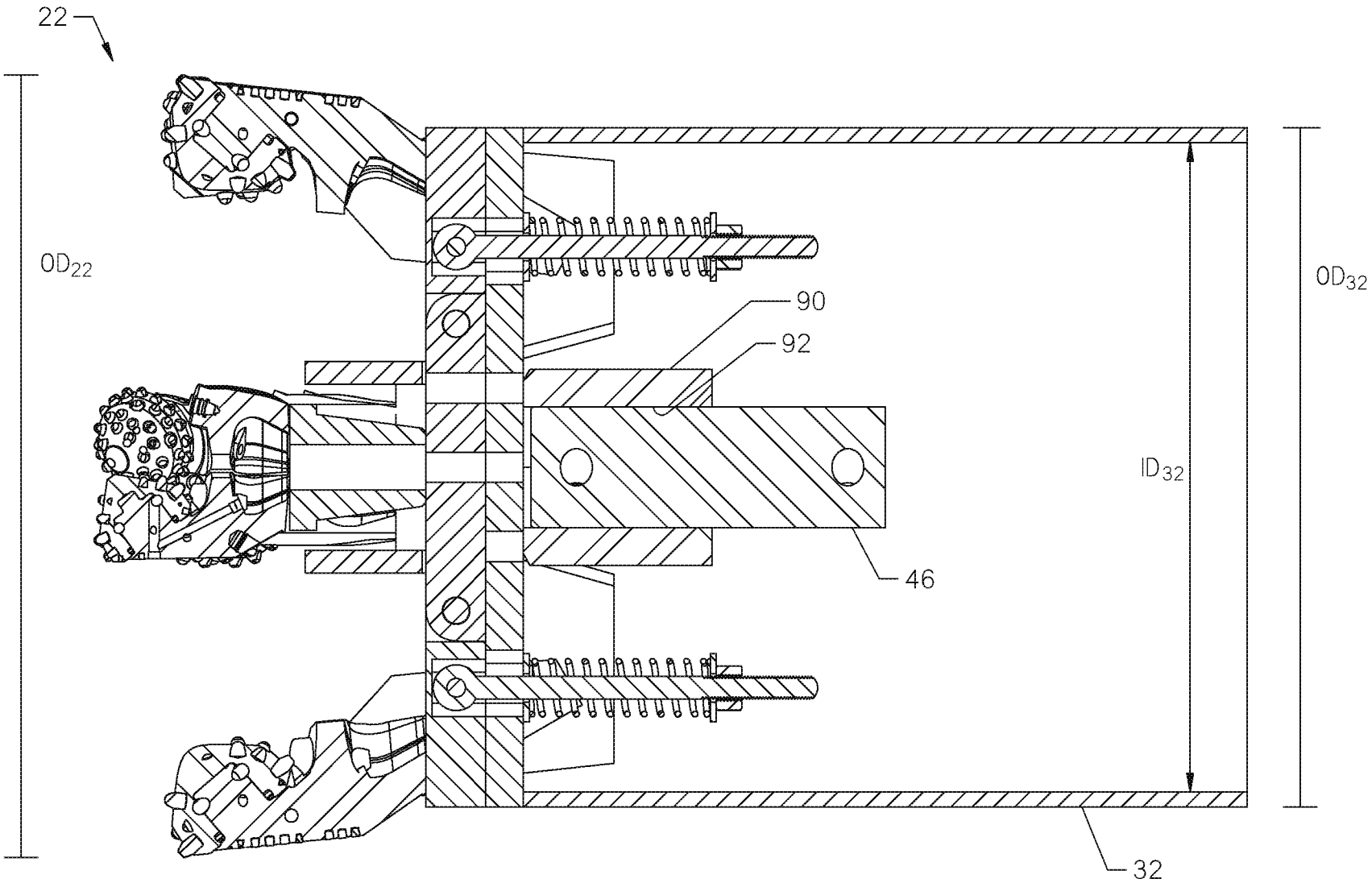
FIG. 11 is a sectional side view of the cutter head of FIG. 3 connected to a shaft.

With reference now to FIGS. 9-11, the cutter head 22 comprises a collar 90 for connection to a corresponding male end of the shaft 46. The shaft 46 may comprise a geometric shape, such as a hexagonal prism. The collar 90 has a cavity 92 with a matching geometric shape. A connection point 94 (FIG. 9), such as a hole for a dowel or bolt, is provided on the collar 90. Alternatively, a splined, threaded or other connection between the shaft 46 and cutter head 22 may be made. Further, the male connector may be placed on the cutter head 22 and the female end on the shaft 46. Gussets 96 are formed between the base plate 50 and the collar 90 to provide structural support for the cutter head 22.

Thus, the cutter head 22 operates in two concentric zones disposed about the longitudinal axis 47. The first, inner zone, has a diameter of $ID_{32}$. The second, outer zone is a ring extending from $ID_{32}$ to the maximum effective diameter of the cutter head 22 when the hinged cutters 60 are in the first position, or $OD_{22}$. The fixed cutters 58 have no axial footprint outside of the inner zone. The hinged cutters 60 are at least partially situated in the outer zone when in the first position.

Figure 12:
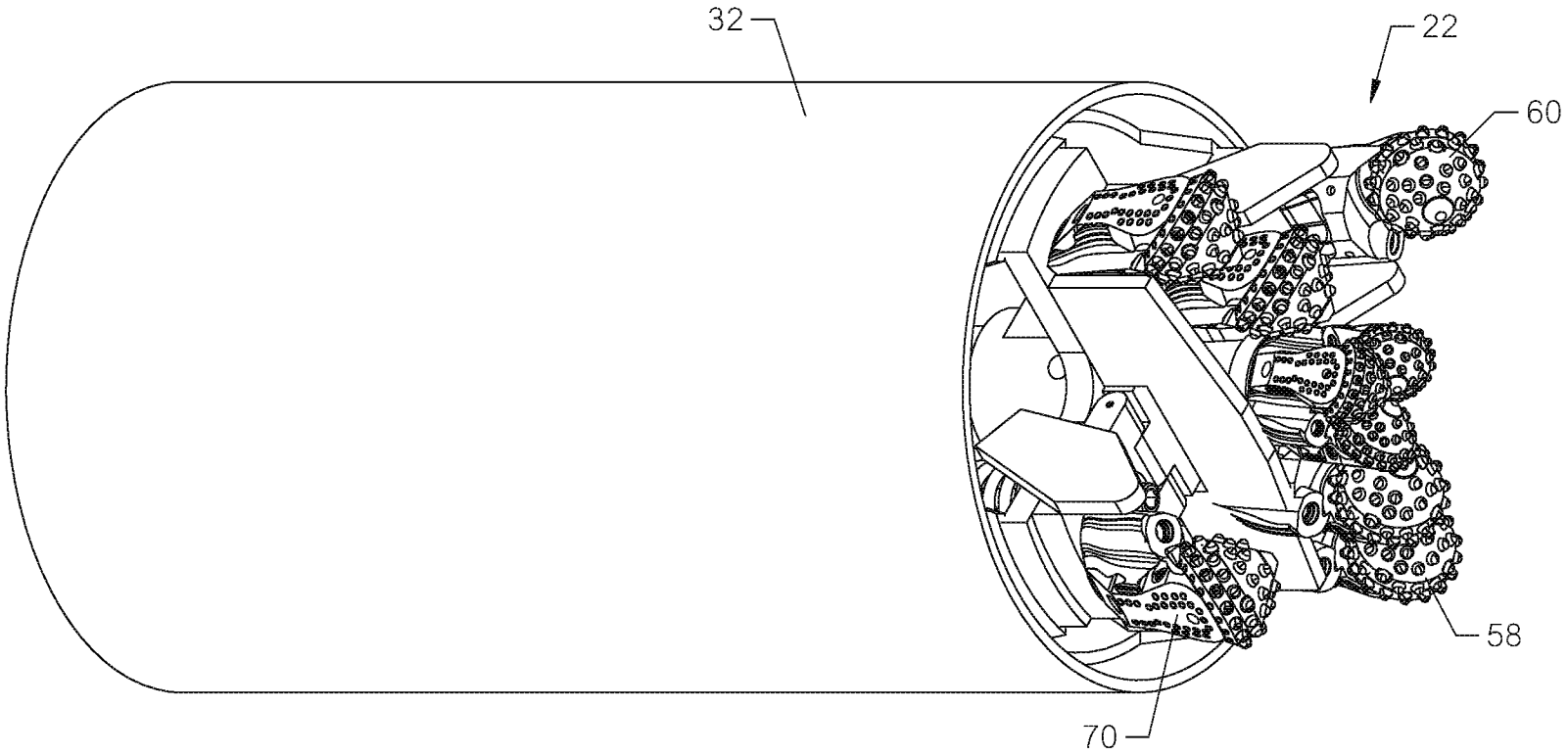
FIG. 12 is a front perspective view of the cutter head with the hinged cutters shown in the first position at an end of a casing.
Figure 13:
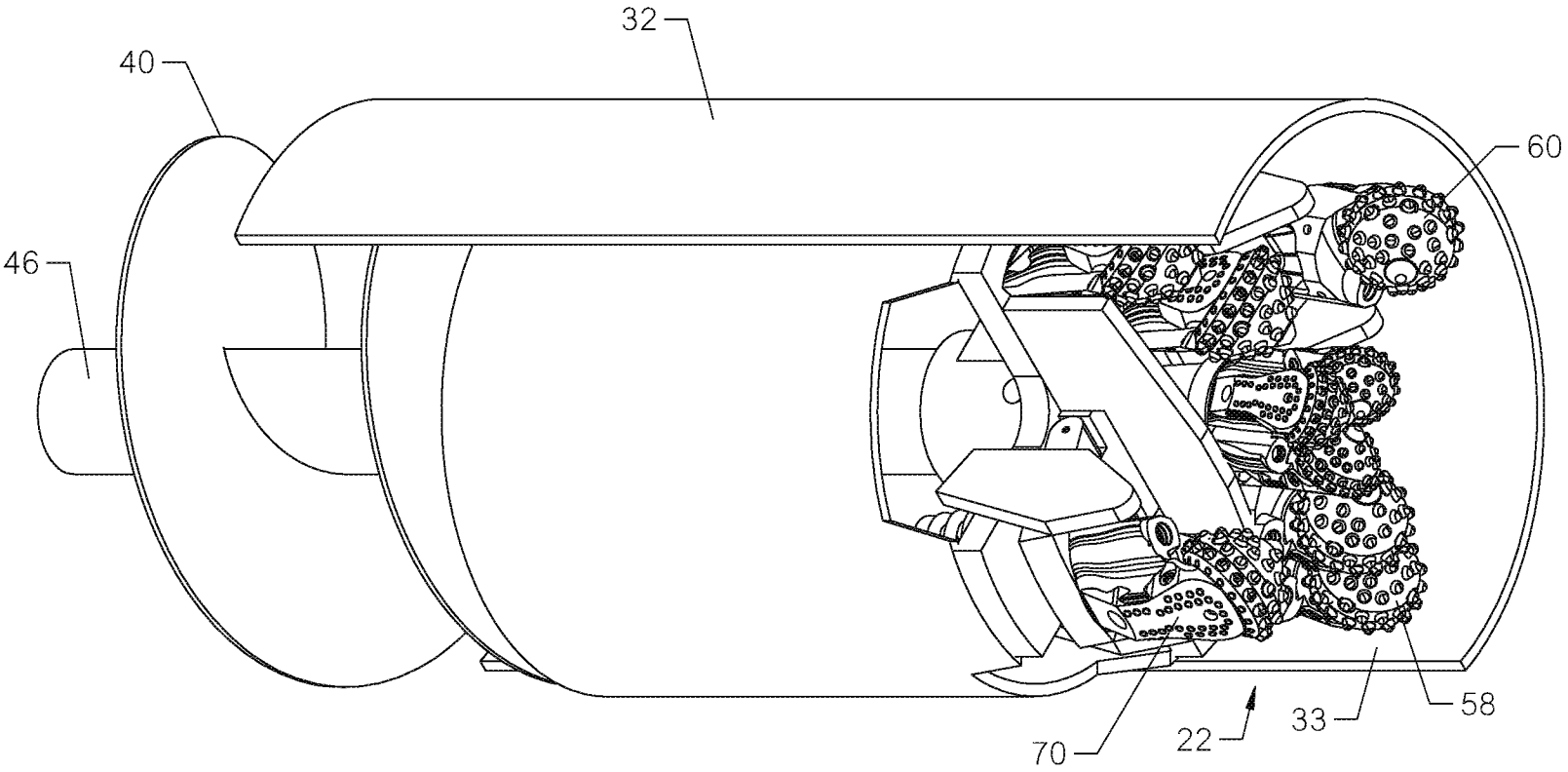
FIG. 13 is a front perspective partial cutaway view of the cutter head with the hinged cutters shown in the second position circumscribed by the casing.

In operation, the cutter head 22 is extended through a first section of casing 32 to a drilling location with the hinged cutters 60 in the second position, as shown in FIG. 13. Upon exiting the casing 32 section, the hinged cutters 60 are moved to the first position by the biaser 62, as shown in FIG. 12. The cutter head 22 is then rotated by the shaft 46, which rotates cutters 58, 60 to open a tunnel 14.

Spoils dislodged by cutters 58, 60 during operation enter the casing 32 around the shaft 46. Rotation of the shaft 46 rotates the auger 40. Spoils are moved out of the tunnel 14 through the casing 32 by rotation of the auger 40. The auger 40 must be oriented such that the direction of rotation of the shaft 46 properly rotates the auger 40 to convey spoils away from the cutter head 22.

The cutter head 22 is then advanced and additional sections of casing 32 are pushed into the tunnel 14 (FIG. 1) by the drilling machine 10. Preferably, this continues until the cutter head 22 reaches an exit point. However, if there is a need to cease boring due to a malfunction or changing soil conditions, rotation may be stopped. The shaft 46 may then be pulled back toward the drilling machine 10.

When the shaft 46 is pulled back toward the drilling machine 10, the contact surface 70 of the hinged cutters 60 will contact the casing 32. When this occurs, the hinged cutters 60 of the cutter head 22 will be forced to move into the second position allowing the cutter head 22 to fit within the casing 32. This allows the casing to circumscribe the entire cutter head 22 enabling removal of the cutter head through the casing, as best shown in FIG. 13.

Once the cutter head 22 is removed from the casing 32, repair or replacement of the cutter head 22 may then occur. Once proper repair or replacement is complete, a cutter head 22 may be placed in the casing 32 and extended to a drilling location so that rotation of the cutter head 22 may resume. The cutter head 22 is extended through the casing 32 to the drilling location with the hinged cutters 60 in a second position. Once the cutter head 22 reaches the drilling location and is removed from the casing 32, the hinged cutters 60 will return to the first position.

Various modifications can be made in the design and operation of the present invention without departing from the spirit thereof. Thus, while the principle preferred construction and modes of operation of the invention have been explained in what is now considered to represent its best embodiments, which have been illustrated and described, it should be understood that the invention may be practiced otherwise than as specifically illustrated and described.

The invention claimed is:

1. A cutting assembly comprising:

a base plate;

a plurality of first bits fixed in position relative to the base plate;

a second bit pivotally attached to a first side of the base plate and movable between a first and second position;

wherein an effective diameter of the cutting assembly is larger when the second bit is in the first position; and a biaser disposed entirely on a second side of the base plate to urge the second bit into the first position.

2. The cutting assembly of claim 1 in which the base plate is configured to form a torque-transmitting connection with an elongate shaft.

3. The cutting assembly of claim 1 wherein the biaser comprises a spring.

4. The cutting assembly of claim 1 further comprising a third bit pivotally attached to the base plate opposite the second bit, wherein the third bit is movable between a first and second position.

5. A system comprising:

the cutting assembly of claim 1, a drilling machine;

a shaft having a first and a second end, wherein the shaft is rotated by the drilling machine at the first end and attached to the cutting assembly at the second end.

6. The system of claim 5 further comprising a casing defining a casing diameter, wherein the shaft is disposed within the casing and wherein the effective diameter is larger than the casing diameter when the second bit is in the first position and wherein the effective diameter is smaller than the casing diameter when the second bit is in the second position.

7. The system of claim 6 further comprising an auger disposed about the shaft.

8. The system of claim 6 in which an outer surface of the second bit is configured to engage an interior wall of the casing when the second bit is in the second position.

9. The cutting assembly of claim 1 in which a longitudinal axis of the biaser is positioned perpendicular to the first side of the base plate when the second bit is in the first position.

10. A cutting assembly having a longitudinal axis, comprising:

a base plate having a center through which the axis extends, and concentric inner and outer zones arranged around the center;

a plurality of static cutting elements supported by the base plate and having no axial footprint within the outer zone;

at least one mobile cutting element supported by the base plate and movable between a first position, in which its axial footprint is at least partially situated within the outer zone, and a second position, in which it has no axial footprint within the outer zone;

a guide plate disposed adjacent to the at least one mobile cutting element to transfer torque from the at least one mobile cutting element to the base plate; and at least one biasing element configured to urge a corresponding mobile cutting element towards its first position, in which the biasing element is disposed on an opposite side of the base plate from the static cutting elements and the at least one mobile cutting element.

11. The cutting assembly of claim 10 in which the static and mobile cutting elements are situated on the same side of the base plate.

12. The cutting assembly of claim 10 in which the at least one mobile cutting element is one of a plurality of identical mobile cutting elements arranged about the axis at uniform angular spacing.

13. The cutting assembly of claim 10 in which at least one mobile cutting element comprises a cutter situated above the base plate and an elongate arm interconnecting the cutter and the base plate and having an externally disposed surface with a convex shape opposite the axis.

14. The cutting assembly of claim 10 in which each mobile cutting element is supported by a movable plate joined to the base plate by a hinge.

15. The cutting element of claim 14 in which each hinged plate connection opens towards the axis.

16. A method, comprising:

positioning an elongate shaft upon which the cutting assembly of claim 10 is supported in coaxial relationship to a tubular underground casing, with the cutting assembly outside the casing with its at least one mobile cutting element in its first position; and drawing the elongate shaft coaxially into the casing until the at least one mobile cutting element of the cutting assembly is in its first position.

17. A system, comprising:

an elongate rotatable shaft having opposed ends;

the cutting assembly of claim 10 supported on one end of the shaft; and a tubular underground casing that contains at least a portion of the shaft.

18. The system of claim 17 in which the cutting assembly has at least one mobile cutting element in its first position and the underground casing contains no portion of the cutting assembly.

19. The system of claim 17 in which the cutting assembly has at least one mobile cutting element in its second position and the underground casing fully contains the cutting assembly.

* * * * *